US006471138B1

(12) United States Patent
Blank et al.

(10) Patent No.: US 6,471,138 B1
(45) Date of Patent: Oct. 29, 2002

(54) ELECTRICALLY INSULATING RAIL SYSTEM

(75) Inventors: Helmuth Blank, Seevetal; Heiko Höft; Bernd Pahl, both of Hamburg, all of (DE)

(73) Assignee: Phoenix Aktiengesellschaft, Hamburg (DE)

( * ) Notice: Subject to any disclaimer, the term of this patent is extended or adjusted under 35 U.S.C. 154(b) by 0 days.

(21) Appl. No.: 09/763,802

(22) PCT Filed: Oct. 6, 1999

(86) PCT No.: PCT/DE99/03217

§ 371 (c)(1),
(2), (4) Date: Feb. 27, 2001

(87) PCT Pub. No.: WO00/23652

PCT Pub. Date: Apr. 27, 2000

(30) Foreign Application Priority Data

Oct. 16, 1998 (DE) ..... 198 47 790

(51) Int. Cl.[7] ..... E01B 13/00
(52) U.S. Cl. ..... 238/122
(58) Field of Search ..... 238/2, 4, 8, 9, 238/122, 125

(56) References Cited

U.S. PATENT DOCUMENTS 4,793,545 A * 12/1988 Raymond ..... 238/8
5,464,152 A 11/1995 Wabnitz
5,622,312 A * 4/1997 Martin ..... 238/8

FOREIGN PATENT DOCUMENTS

| | | |
|---|---|---|
| DE | 84 12 347.8 | 7/1984 |
| DE | 33 45 388 | 6/1985 |
| DE | 42 23 270 | 1/1994 |
| EP | 0 726 359 | 8/1996 |
| EP | 0 863 256 | 9/1998 |
| WO | WO95/30796 | 11/1995 |
| WO | WO96/13636 | 5/1996 |

* cited by examiner

*Primary Examiner*—S. Joseph Morano
*Assistant Examiner*—Robert J. McCarry, Jr.
(74) *Attorney, Agent, or Firm*—Collard & Roe, P.C.

(57) ABSTRACT

The invention relates to a rail system consisting of a rail, especially a grooved rail, comprising a head, stem and foot, whereby a base profile, made of an elastomeric material is for the most part arranged underneath the foot of the rail, in addition to guard rail tie bars that are preferably provided with an encasing profile made of an elastomeric material, a driving track made of concrete or other building materials with a built-in space for receiving the rail, packing made of an elastomeric material arranged on both sides of the rail, in addition to a fixture for said rail. The inventive rail system is characterized in that the packing, once it is adapted to the contour of the rail, fills the remaining gap entirely and is provided with electrical insulation.

18 Claims, 4 Drawing Sheets

ELECTRICALLY INSULATING RAIL SYSTEM

CROSS REFERENCE TO RELATED APPLICATIONS

Figure 1:
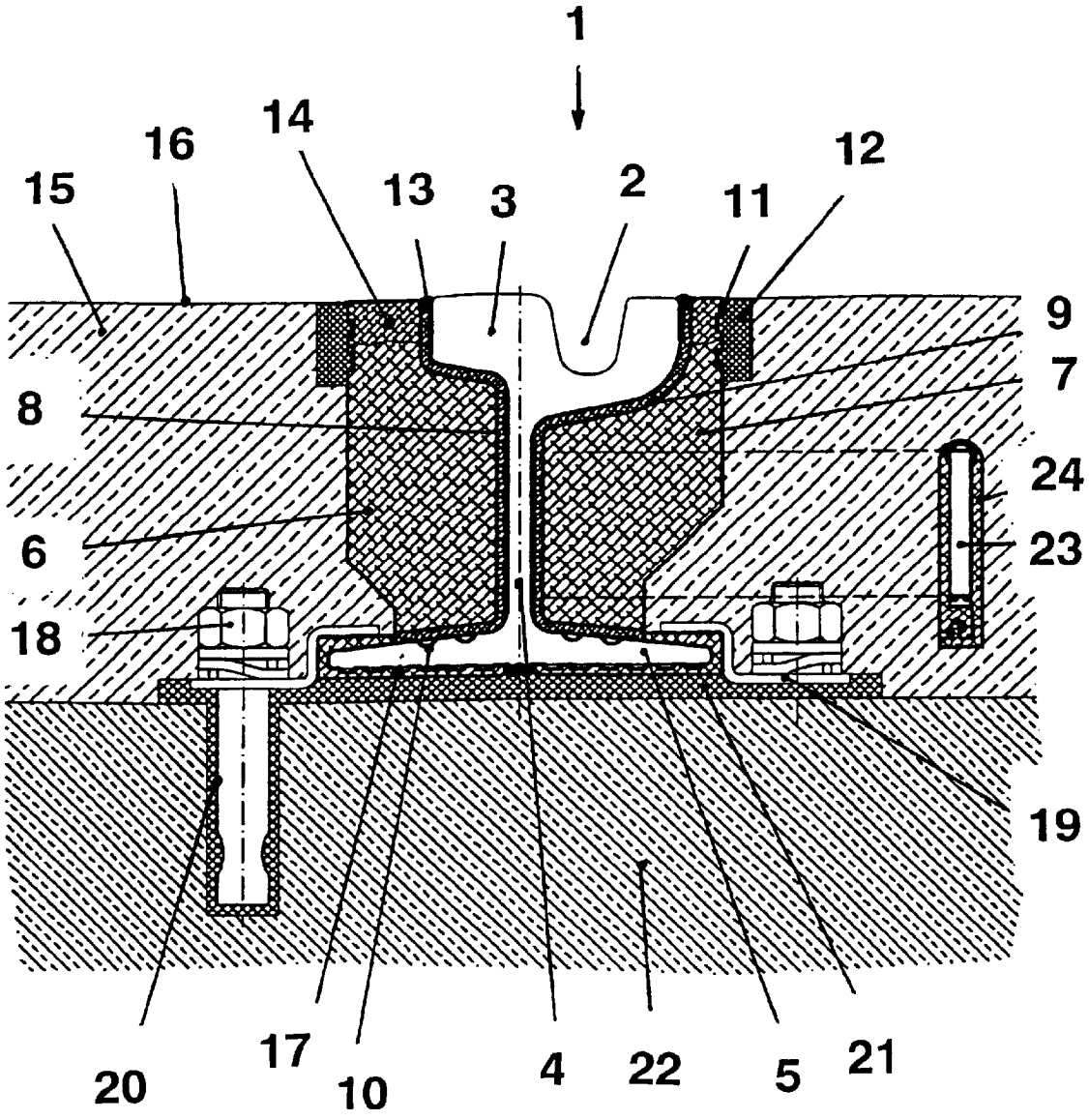

Applicants claim priority under 35 U.S.C. §119 of German Application No. 198 47 790.2 filed Oct. 16, 1998. Applicants claim priority under 35 U.S.C. §120 of PCT/DE99/03217 filed Oct. 6, 1999. The international application under PCT article 21 (2) was not published in English.

DESCRIPTION

The invention relates to a rail system consisting of a grooved rail comprising a rail head, a rail stem and a rail foot, whereby a base profile made of an elastomeric material is arranged underneath the foot of the rail in most cases, as well as rail tie bars which are preferably provided with a profile encasing the rail tie bars, said profile being made of an elastomeric material;

a driving track made of concrete or other construction materials (for example such as stone pavements), with an integrated joint space for receiving the grooved rail;

a packing body made of elastomeric material, said packing body being arranged on both sides of the grooved rail and, with adaptation to the contour of the rail, completely filling the remaining space of the joint;

a fixture for securing the rail; as well as an electrical insulation.

A rail system using a grooved rail, as it can be found in communal traffic, is described, for example in the published patent documents DE-A-33 45 388; DE-U-84 12 347; WO-A-95/30796; and WO-A-96/13636.

It is furthermore known from patent application EP-A-0 726 359 that the fixture for securing the rail comprises an electrically insulating dowel, whereby the head of the fixture is separated from the foot of the rail and the sub-construction by electrically insulating intermediate layers.

Furthermore, a rail system is introduced in patent specification U.S. Pat. No. 5,464,152, in conjunction with which the rail is encased with an elastomeric material that insulates the rail electrically at the same time.

Based on the overall prior art cited above, the problem of the invention consists in providing a rail system, in conjunction with which the leakage current component and the corrosion caused by voltage are minimized within the framework of communal traffic, whereby a superior deformation capability, a compact tie-up to the road construction material (which is particularly important in conjunction with stone pavements), increased damping of the rail as well reduced emission of noise are to be assured at the same time.

Said problem is solved according to the characterizing part of patent claim 1 in that the packing body is provided on both sides of the grooved rail with an electrical insulation which is on each side a thin insulation layer as compared to the packing body, such a packing body extending on each side from the surface of the driving track up to the foot of the rail.

Based on the state of the art of a rail system of such a type, as it is described, for example in the published patent documents DE-A-33 45 388; DE-U-84 12 347; WO-A-95/30796; and WO-A-96/13636, the problem of the invention is to provide a rail system in conjunction with which higher deformation capabability, a compact tie-up to the road construction material (which is very important especially in conjunction with stone pavements), increased damping of the rail, as well as a reduction of the emission of noise are assured within the framework of the communal traffic. Furthermore, the goal is to reduce the leadage current component and the corrosion caused by the voltage.

Said problem is solved according to the characterizing part of patent claim 1 in that the packing body, once it has been adapted to the contour of the rail, completely fills the remaining gap of the joint, and is provided with an electrical insulation.

Useful further developments of the rail system as defined by the invention are specified in claims 4 to 21.

A further problem of the invention is to provide a method for producing the rail system according to the invention that assures simple and also efficient installation of the packing body.

Said problem is solved according to the characterizing part of claim 22 in that the packing body is pressed against the rail on both of its sides by means of a clamping device comprising a frame with clamping jaws, whereby at least one clamping jaw can be adjusted.

A useful step of the method is specified in claim 23.

Figure 2:
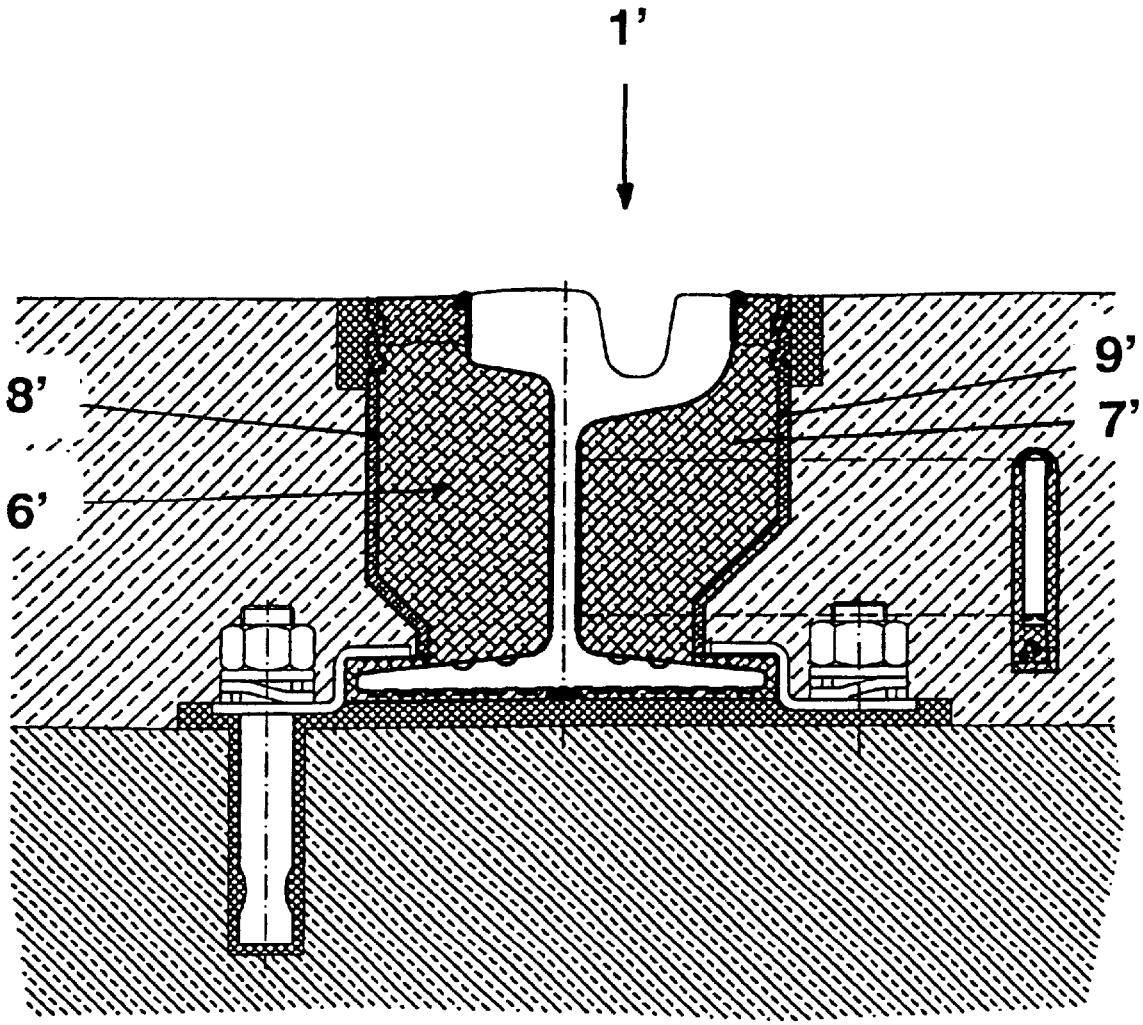
Figure 3:
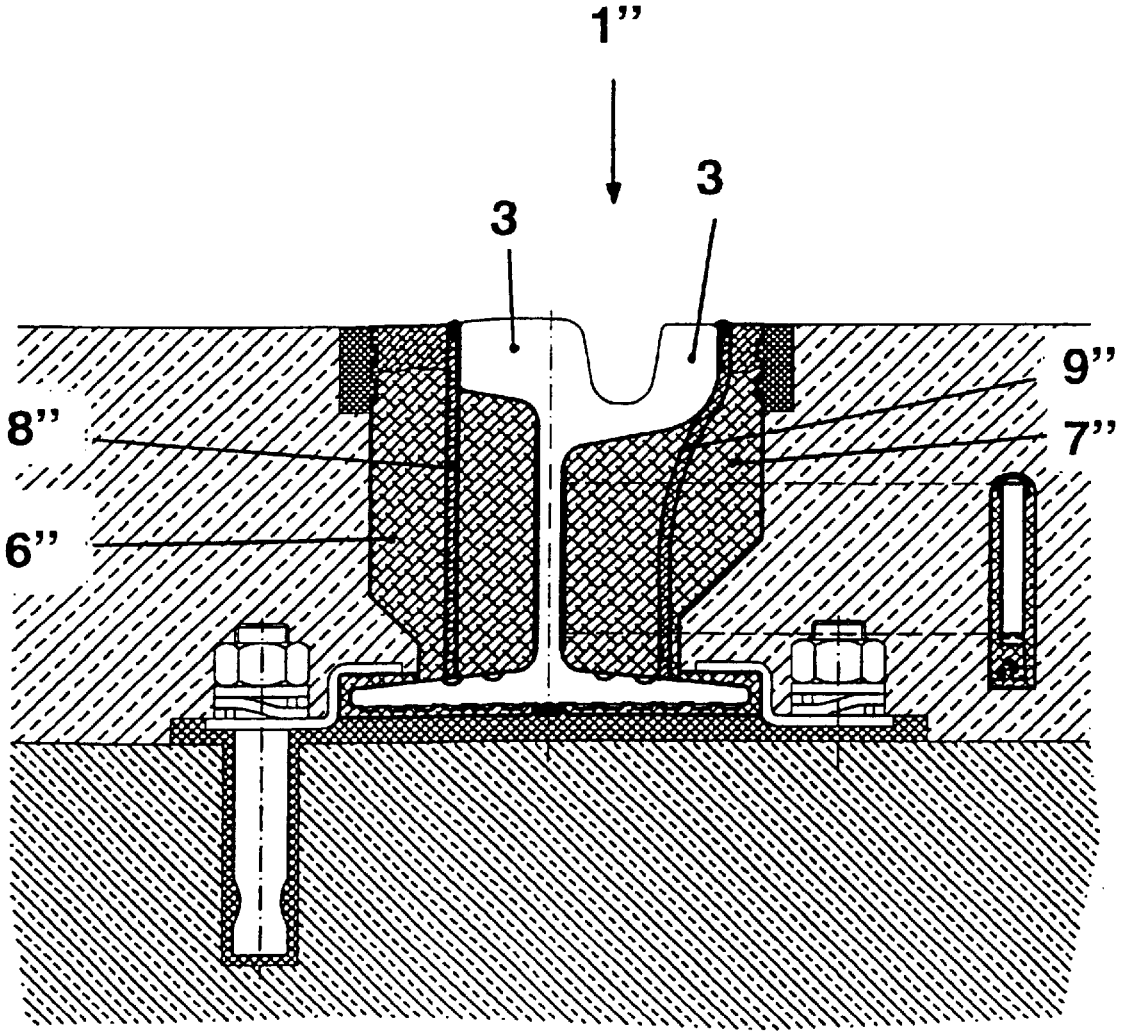
Figure 4:
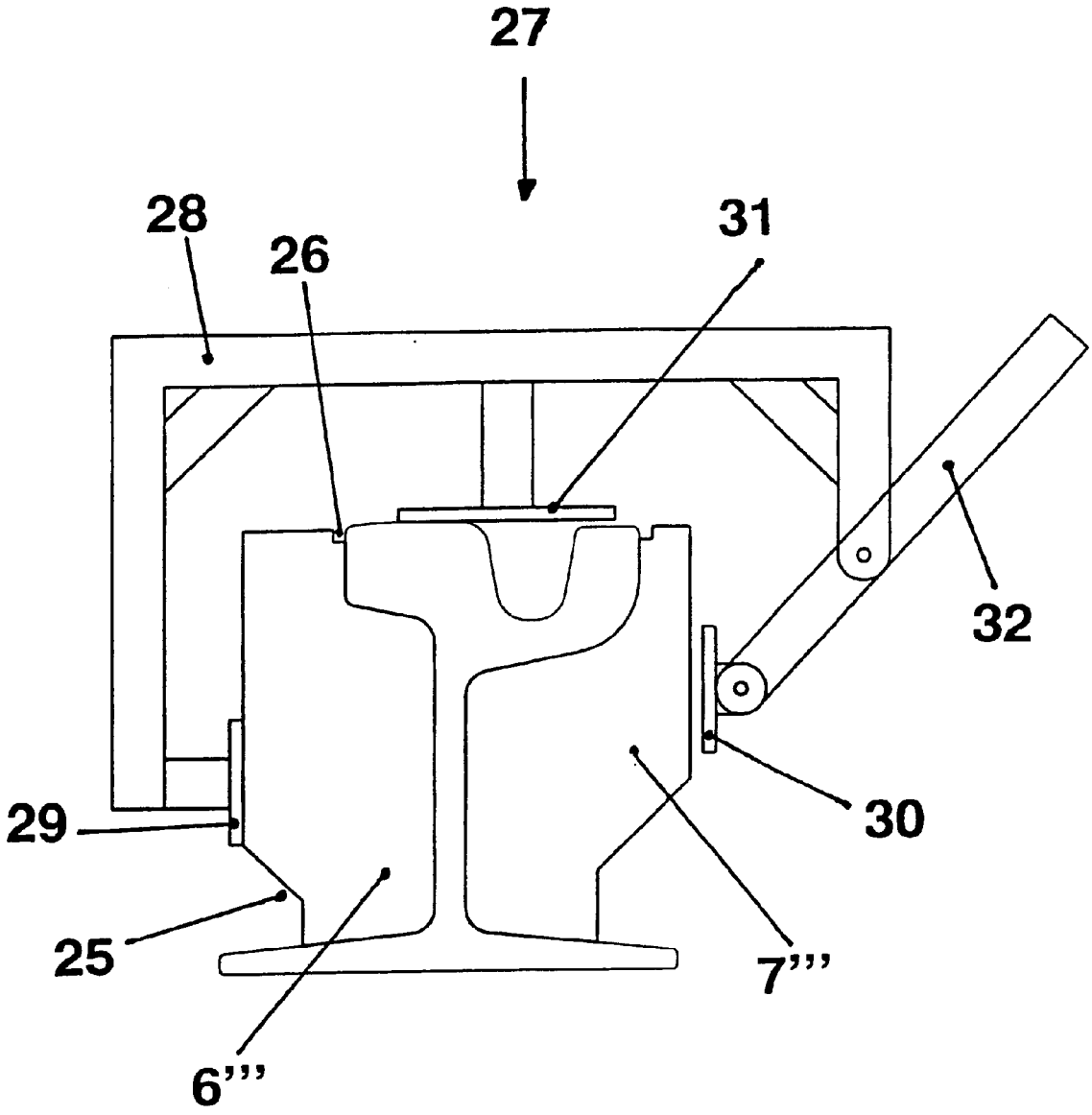

Now, the invention is explained in the following with the help of exemplified embodiments and by reference to schematic drawings (cross sectional representations). In the drawings, FIGS. 1 to 3 show three variations of the rail system;

FIG. 4 shows a clamping device.

The following list of reference numerals and symbols applies to said figures:

1, 1', 1" Rail system
2 Grooved rail
3 Rail head
4 Rail stem
5 Rail foot
6, 6', 6", 6'" Packing body consisting of an elastomeric material
7, 7', 7", 7'" Packing body consisting of an elastomeric material
8, 8', 8" Electrical insulation
9, 9', 9" Electrical insulation
10 Strip
11 Groove
12 Joint material for the expansion joint
13 Joint material for the fillet
14 Wearing layer
15 Driving track
16 Driving track pavement
17 Base profile (foot profile) made of an elastomeric material
18 Fixture for securing the rail
19 Clamping clip
20 Screw dowel
21 Base plate for fastening the rail
22 Sub-base
23 Rail tie bar
24 Encasing profile made of elastomeric material for encasing the rail tie bars
25 Recess in packing body
26 Fillet
27 Clamping device
28 Frame
29 Rigid clamping jaw
30 Adjustable clamping jaw
31 Rigid or adjustable clamping jaw
32 Lever According to FIG. 1, the two packing bodies 6 and 7 of the rail system 1, which are free of cavities, each are provided with an electrical insulation 8 and, respectively, 9. Said packing bodies each extend from the driving track surface 16 up to the foot 5 of the rail, specifically extending along the contour of the rail.

On their bottom sides facing the rail foot 5, the packing bodies 6 and 7 each are equipped with the two strips 10 extending in the longitudinal direction of the rail and having a cross sectional shape substantially in the form of a semicircle. Said strips serve the purpose of compensating tolerances.

Furthermore, on the outer sides, the packing bodies 6 and 7 each are tapered within their lower zones, specifically forming in this way a recess 25 (FIG. 4). Said recess serves as space for receiving the fixture 18 for securing the rail, whereby the recess is located either only within the zone of the respective fixture for securing the rail, or said recess extends through in the longitudinal direction of the rail. The size of the recess can be adapted to the fixture employed for securing the rail.

Furthermore, the packing bodies 6 and 7 each are provided on the outer sides within their upper zones with at least one groove 11 extending in the longitudinal direction of the rail, whereby an expansion joint adjoins said groove within said zone. Said expansion joint is filled with a watertight joint filler material 12. The grooves 11 assure in this conjunction superior adhesion of the joint filler material 12 to the packing body.

Furthermore, within the zone of the surface 16 of the driving track, the packing bodies 6 and 7 each have a fillet 26 (FIG. 4) that faces the rail head 3, said fillet being filled with a watertight joint material 13 as well, which is specifically intended for the purpose of joining the packing body with the head of the rail in a watertight manner.

Moreover, the packing bodies 6 and 7 each are provided with a protective layer 14 facing the surface 16 of the driving track. Said protective layer is resistant to abrasion as well as to ozone, UV-rays, oil, gasoline and chemicals.

FIG. 2 shows a rail system in conjunction with which the two packing bodies 6' and 7' each are provided with an electrical insulation 8' and 9', respectively, which extends in each case along the outer side of the packing body, i.e. along the side disposed opposite the contour of the rail.

According to FIG. 3, the two packing bodies 6" and 7" of the rail system 1" each are provided with an electrical insulation 8" and, respectively, 9", which first extends in each case along the rail head 3 and then continues to extend vertically (insulation 8") or in a curved form (insulation 9") substantially through the center of the packing bodies 6" and 7", respectively.

The electrical insulation 8, 8', 8" and 9, 9', 9" according to the exemplified embodiments shown in FIGS. 1 to 3 is a thin layer of insulation as compared to the packing body. Said thin insulating layer is present in the form of an electrically insulating mixture or in the form of an electrically insulating foil material. The electrical insulation is in this conjunction incorporated in the packing body by vulcanizing it into the packing body.

The packing body consists of a material that is impermeable to water, preferably in conjunction with a structure that is free of cavities (i.e. no channels are enclosed in the longitudinal direction of the rail; DE-A-33 45 388; FIG. 1). With a thickness of >1.2 kg/dm$^3$, the packing body particularly consists of EPDM, whereby a regenerated rubber can be used as well (with a 40% to 80% by wt. component of the latter). The packing body can be usefully glued to metal.

Now, FIG. 4 shows a clamping device 27 comprising a frame 28 with a rigid clamping jaw 29, an adjustable clamping jaw 30 (actuated by the lever 32), as well as a rigid or adjustable clamping jaw 31. The two packing bodies 6'" and 7'" are pressed against the rail by means of said clamping ice, particularly with the use of a contact adhesive.

What is claimed is:

1. A rail system comprising:

a. a grooved rail comprising:
   i. a rail head;
   ii. a railstem;
   iii. a rail foot;
   iv. a base profile made of an elastomeric material arranged underneath said rail foot;
   v. a plurality of rail tie bars; and
   vi. an encasing profile made of an elastomeric material for encasing said plurality of rail tie rods;

b. a driving track, having a surface, and made of concrete or other construction materials, said driving track having an integrated joint in which said grooved rail is seated;

c. a packing body made of an elastomeric material and arranged on both sides of said grooved rail) extending from said surface of said driving track to said rail foot, wherein said packing bodyhas an inner side, an outer side, a bottom aide, a lower zone, and an upper zone, and wherein once said packing body is adapted to a contour of said grooved rail, it completely fills a remaining space of said integrated joint;

d. a fixture for securing said grooved rail;

e. an electrical insulation provided as a thin layer on both sides of said grooved rail extending from said surface of said driving track to said rail foot; and f. a protective coating on said packing body facing said surface of said driving track, wherein said protective coating is resistant to abrasion, ozone, UV-radiation, oil, gasoline and chemicals, and wherein said protective coating preferably consists of a rubber mixture based on EPDM.

2. The rail system according to claim 1, wherein said electrical insulation exclusively extends along a contour of said grooved rail on said inner side of said packing body.

3. The rail system according to claim 1, wherein said electrical insulation exclusively extends along said outer side of said packing body, which is a side disposed opposite a contour of the rail.

4. The rail system according to claim 1, wherein said electrical insulation first extends along said rail head and then continues to extend vertically in a curved way substantially through a center of said packing body.

5. The rail system according to claim 1, wherein said electrical insulation comprises an electrically insulating mixture.

6. The rail system according to claim 1, wherein said electrical insulation comprises an electrically insulating plastic fail.

7. The rail system according to claim 1, wherein said electrical insulation is incorporated into said packing body by vulcanization.

8. The rail system according to claim 1, further comprising at least one strip, on said bottom side of said packing body, facing said rail foot, said strip extending in a longitudinal direction of said grooved rail and having a cross section substantially in a form of a semicircle.

9. The rail system according to claim 1, wherein said packing body is tapered on said outer side within said lower zone, forming a recess for receiving a fixture for securing said grooved rail, wherein said recess either is present only within a zone of the respective rail fixture or it extends in a longitudinal direction of the rail.

10. The rail system according to claim 1, further comprising at least one groove, extending on said outer side within said upper zone of said packing body.

11. The rail system according to claim 10, further comprising an expansion joint adjoined on said outer side of said packing body within its upper zone, wherein said expansion joint is filled with a watertight joint filler material which is permanently elastic.

12. The rail system according to claim 1, further comnprising a fillet disposed on said packing body in a zone of said driving track surface and facing said rail head, wherein said fillet is filled with a watertight joint material which is permanently elastic.

13. The rail system according to claim 1, wherein said packing body consists of a material impermeable to water, in conjunction with a structure which i: free of cavitleo.

14. The rail system according to claim 1, wherein said packing body can be glued to metal.

15. The rail system according to claim 1, wherein a rubber regenerate component of said protective coating amounts to 20% by weight at the most, whereas the basic body of said packing body has a rubber regenerate component of from 40% to 60% by weight.

16. A rail system comprising:

a. a grooved rail comprising:
   i. a rail head;
   ii. a railstem;
   iii. a rail foot;
   iv. a base profile made of an elastomeric material arranged underneath said rail foot;
   v. a plurality of rail tie bars; and
   vi. an encasing profile made of an elastomeric material for encasing said plurality of rail tie rods;

b. a driving track, having a surface, and made of concrete or other construction materials, said driving track having an integrated joint in which said grooved rail is seated;

c. a packing body having a density of >1.3 kg/dm$^3$, made of an elastomeric material and arranged on both sides of said grooved rail, extending from said surface of said driving track to said rail foot, wherein once said packing body is adapted to a contour of said grooved rail, it completely fills a remaining space of said integrated joint;

d. a fixture for securing said grooved rail; and e. an electrical insulation provided as a thin layer on both sides of said grooved rail extending from said surface of said driving track to said rail foot.

17. A rail system comprising:

a. a grooved rail comprising:
   i. a rail head;
   ii. a railstem;
   iii. a rail foot;
   iv. a base profile made of an elastomeric material arranged underneath said rail foot;
   v. a plurality of rail tie bars; and
   vi. an encasing profile made of an elastomeric material for encasing said plurality of rail tie rods;

b. a driving track, having a surface, and made of concrete or other construction materials, said driving track having an integrated joint in which said grooved rail is seated;

c. a packing body made of a rubber mixture based on ethylene-propylene-diene-copolymer (EPDM) and arranged on both sides of said grooved rail, extending from said surface of said driving track to said rail foot, wherein once said packing body is adapted to a contour of said grooved rail, it completely fills a remaining space of said integrated joint;

d. a fixture for securing said grooved rail; and e. an electrical insulation provided as a thin layer on both sides of said grooved rail extending from said surface of said driving track to said rail foot.

18. A rail system comprising:

a. a grooved rail comprising:
   i. a rail head;
   ii. a railstem;
   iii. a rail foot;
   iv. a base profile made of an elastomeric material arranged underneath said rail foot;
   v. a plurality of rail tie bars; and
   vi. an encasing profilemade of an elastomeric material for encasing said plurality of rail tie rods;

b. a driving track, having a surface, and made of concrete or other construction materials, said driving track having an integrated joint in which said grooved rail is seated;

c. a packing body made of a rubber regenerate particularly based on EPDM and arranged on both sides of said grooved rail, extending from said surface of said driving track to said rail foot, wherein once said packing body is adapted to a contour of said grooved rail, it completely fills a remaining space of said integrated joint;

d. a fixture for securing said grooved rail; and e. an electrical insulation provided as a thin layer on both sides of said grooved rail extending from said surface of said driving track to said rail foot.

* * * * *

UNITED STATES PATENT AND TRADEMARK OFFICE

CERTIFICATE OF CORRECTION

PATENT NO. : 6,471,138 B1
DATED : October 29, 2002
INVENTOR(S) : Blank et al.

It is certified that error appears in the above-identified patent and that said Letters Patent is hereby corrected as shown below:

Column 4,
Line 23, after the word "rail", please delete the ")".
Line 25, after the word "body", please put in a space before the word "has".
Line 57, please change the word "fail" to -- foil --.

Column 5,
Lines 14 and 15, after the word "further", please delete the words "comn-" and "prising" and insert -- comprising --.
Line 21, after the word "which", please delete "i:" and insert -- is --.
Line 21, after the word "of" please delete "cavitleo" and insert the word -- cavities --.

Signed and Sealed this

Fifteenth Day of July, 2003

JAMES E. ROGAN
*Director of the United States Patent and Trademark Office*